US006341993B1

(12) United States Patent
Lalli, Jr.

(10) Patent No.: US 6,341,993 B1
(45) Date of Patent: Jan. 29, 2002

(54) MOTORIZED SWIM FIN

(76) Inventor: William J. Lalli, Jr., 65 Ivyhurst Rd., Eggertsville, NY (US) 14226

( * ) Notice: Subject to any disclaimer, the term of this patent is extended or adjusted under 35 U.S.C. 154(b) by 0 days.

(21) Appl. No.: 09/655,051

(22) Filed: Sep. 5, 2000

(51) Int. Cl.[7] ..... A63B 31/08
(52) U.S. Cl. ..... 441/64; 114/315; 440/6
(58) Field of Search ..... 440/6; 441/61, 441/64; D21/806; 114/315

(56) References Cited

U.S. PATENT DOCUMENTS 3,422,787 A * 1/1969 Rush ..... 440/6
3,635,188 A * 1/1972 Rutkowski ..... 440/6
4,083,071 A * 4/1978 Forjot ..... 441/64
4,627,820 A * 12/1986 Penebre ..... 441/64
4,700,654 A * 10/1987 Borges ..... 114/338
4,938,722 A * 7/1990 Rizley ..... 440/6
5,595,518 A * 1/1997 Ours ..... 441/64
5,766,050 A * 6/1998 Maggi ..... 441/63

* cited by examiner

*Primary Examiner*—S. Joseph Morano
*Assistant Examiner*—Andrew Wright
(74) *Attorney, Agent, or Firm*—Crossetta & Associates

(57) ABSTRACT

The present invention comprise a swim fin having an internal propulsion system, wherein the fin is secured to the wearer by a boot configured to surround the foot and ankle of the wearer resisting flexure of the ankle, the fin is integrally molded to the boot and comprises an integral, longitudinally extending tubular passageway having an inlet adjacent about the toe end of the boot and an outlet arranged at about the remote end of the fin, and the tubular passageway contains a motor driven shaft having a propeller arranged to rotate and forcibly push fluid entering the inlet of the passageway through the outlet thereof.

20 Claims, 3 Drawing Sheets

MOTORIZED SWIM FIN

The present invention relates to underwater personal propulsion devices, specifically to a hands-free personal propulsion device which pushes an underwater diver or swimmer through the water, and enables personal control of direction and speed through an aquatic environment with minimum or no use of hands and maximum turning agility, without the restriction of cumbersome back-worn devices.

BACKGROUND OF THE INVENTION

Underwater swimming and diving is a popular sport and hobby which has gained increasing popularity throughout the world. Since underwater diving time is generally limited by the amount of air which can be carried by the diver, and the amount of air consumed by a diver is related to the amount of energy a diver expends, there is generally a significant limitation in the amount of geographic area which a diver can traverse during an underwater diving experience.

Various devices have been developed to aid the transport of a diver through the aquatic environment, generally being bulky devices or vehicles which the diver must ride or otherwise grasp which pulls the diver in the direction desired. Such devices are typically bulky and heavy, require skillful hand guidance by the diver, and once the diver reaches his destination must be tended, monitored or otherwise cared for, thus limiting the diver's freedom of independent activity once he has arrived at his destination.

One important aspect of the diving experience is the close viewing and hands-on manipulation of objects which may be found or seen in the underwater environment. Typically, a diver desires and even needs complete freedom of movement during such experience, and the need to closely monitor or be tethered to a propelling device can be distracting and very limiting to the experience. Losing sight and/or contact with a propelling device in a murky underwater environment can result in loss of the device and/or wasted time and/or air trying to relocate the device.

The prior art is replete with various proposed improvements to underwater transport devices. U.S. Pat. No. 4,700,654 discloses an embodiment of a motorized propulsion device comprising a motor, a battery, and control switches which are contained in a water-tight housing and connected to a propeller. The housing is attached to the swimmer's forearms and the control switches may be operated by the swimmer's fingers. The device appears to be effective in providing a forward propulsion from the elbows of a swimmer, but limits both hand movement and arm motion of the swimmer by increasing weight and adding bulk.

U.S. Pat. No. 3,422,787 discloses an embodiment of an underwater propulsion system comprising a housing strapped between the calves of the swimmer's legs that contains an electric motor and a propeller, a belt disposed about the swimmer's waist attached to which are several wet cell storage batteries, and a waterproof cable that connects the batteries to the motor. This device appears to severely restrict a swimmer's mobility as the swimmer's legs are bound together by the housing of the propelling device.

U.S. Pat. No. 3,635,188 discloses an embodiment of an underwater propulsion device comprising a pair of structural housings that are attached one to the underside of each foot of a swimmer so as to point downward from about the arch of the foot, each housing containing a motor and a propeller. The motors in these units are coupled to at least one power supply carried by the swimmer on a belt worn about the waist. As with the previous patent, the device is effective in propelling a swimmer but requires an unnatural steering technique in which an unusual flexure of the knees and torso of a swimmer appear to be required to steer. The use of a battery belt and power supply cables running the length of the swimmer's legs could interfere with myriad other diving apparatus.

The devices of the above prior art disclosures appear to be inconvenient to the user, restricting the swimmer to cumbersome propulsion devices that require significant limitations in bodily movement, and/or added weight. In each instance they appear to diminish a swimmer's agility and restrict the types of bodily movement that many tasks involved in swimming and diving may require.

An object of the present invention is to provide an underwater propelling device which can be conveniently operated by an underwater swimmer.

Another object of the invention is to provide an underwater propelling device which can provide convenient directional changes by hands-free or minimum hand movement.

Another object of the invention is to provide an underwater propelling device which is conveniently non-interfering with the diving experience and self-tending when not being used.

A still further object of the invention is to provide an underwater propelling device which closely simulates natural human underwater diving techniques.

These and other objects of the invention will be apparent from the following description of the invention.

SUMMARY OF THE INVENTION

Swim fins are generally considered standard equipment for underwater divers and swimmers and the technique of their use in propelling the diver in the diving experience is generally considered natural in that like walking, it is generally quickly adopted to become a natural activity without thought. Swim fins generally comprise a generally flat, thin flexible paddle extending from a shallow foot well configured to secure the fin to the wearers foot. The thin paddle exaggerates the width and length of the toe portion of the foot to approximate that of a rear fin. The foot well is configured to enable secure mounting of the fin to the foot while generally maximizing forward and rearward flexure of the wearers ankle so as to provide maximum agility to the diver as he propels himself forward using a swimmers kick.

In its broadest form, the present invention comprises the combination of a propelling device and a modified swim fin. In the modified swim fin of the invention, the foot well of the swim fin is modified from enabling generally unrestricted flexure of the ankle to restricted flexure of the ankle, while the paddle of the swim fin is modified to comprise a generally cylindrical shape extending along about its longitudinal centerline, defining an interior passageway having openings thereto at opposite ends for the forced propulsion of water therethrough.

In a preferred embodiment, the foot well of the swim fin comprises a boot arrangement, wherein the boot surrounds the foot and extends above the ankle of the wearer, sufficiently tightened around the ankle to resist forward and rearward flexure of the foot at the ankle to less than about 75% of normal.

In one embodiment, the swim fin is formed from an elastomeric compound, straps, snaps or like means are provided to enable secure attachment of the boot to the ankle and foot of the wearer.

The paddle is connected to the foot well of the swim fin, at about adjacent the toe of the boot. The swim fin comprises a generally longitudinally extending tubular passageway, having an inlet arranged adjacent about the toe of the boot and having an outlet arranged at about the remote end of the paddle. Wherein the tubular passageway comprises means for forcing fluid entering the inlet of the passageway through the outlet thereof.

In a preferred embodiment of the invention, the means for forcing fluid comprises a power driven rotatable shaft having at least one propeller arranged to forcibly push fluid entering the inlet of the passageway through the outlet thereof.

In a further preferred embodiment of the invention, the rotatable shaft is powered by an electric motor in electrical circuitry with a power supply. In a particularly preferred embodiment, the electric motor is variable and/or multiple speed, the power supply is remote from the swim fin, and switching means controlling the motor, is in electrical circuitry therewith.

In a further preferred embodiment, the inlet to the tubular passageway comprises a means for preventing the intake of vegetation, small fish, and the like into the passageway. In a particularly preferred embodiment, mesh screens are arranged at about the intake to the passageway, and the outlet from the tubular passageway is spaced inward from the remote end of the paddle.

It should be understood that the present invention contemplates multiple further diverse configurations and arrangements for forcibly pushing fluid and propelling a swimmer that are in accord with the spirit of the invention wherein propulsion is assisted by forcing fluid through modified swim fin means. Thus, for example, the method for the intake of fluid through the inlet and propulsion of fluid through the outlet may comprise jet means. The paddle may comprise a plurality of inlets and outlets enabled to allow an alternate flow of water through the passageway rather than the preferred embodiment of the invention. These and other embodiments of the invention will be apparent from the following detailed description of the invention.

BRIEF DESCRIPTION OF THE FIGURES

The nature and mode of operation of the present invention is more fully described in the following detailed description of the accompanying drawings.

DETAILED DESCRIPTION OF THE INVENTION

Figure 1:
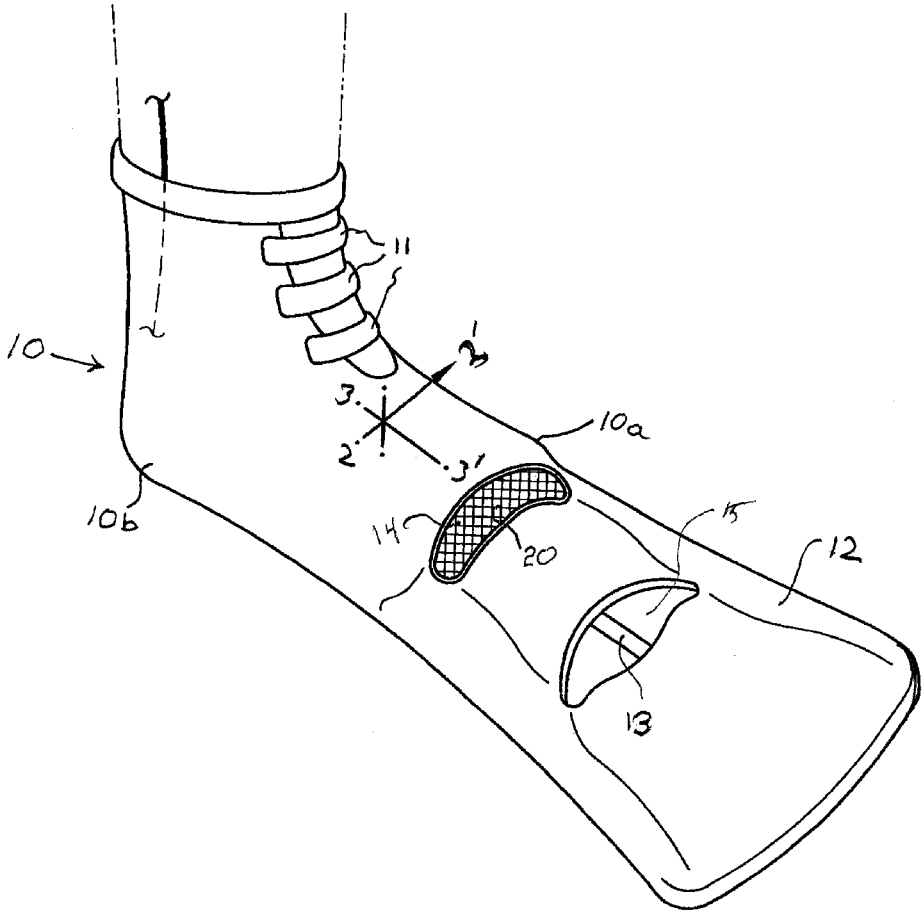
FIG 1 is an exploded perspective view of a motorized swim fin of the invention.
Figure 2:
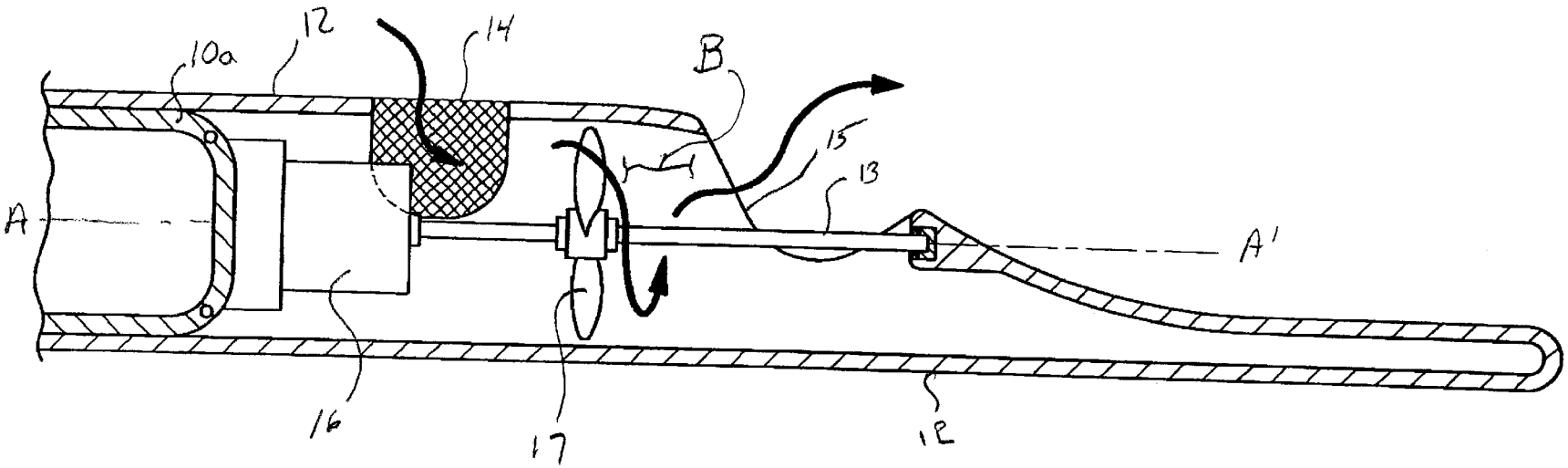
FIG. 2 is a sectional plan view of the motorized swim fin of FIG. 1 taken along about line 2–2'.
Figure 3:
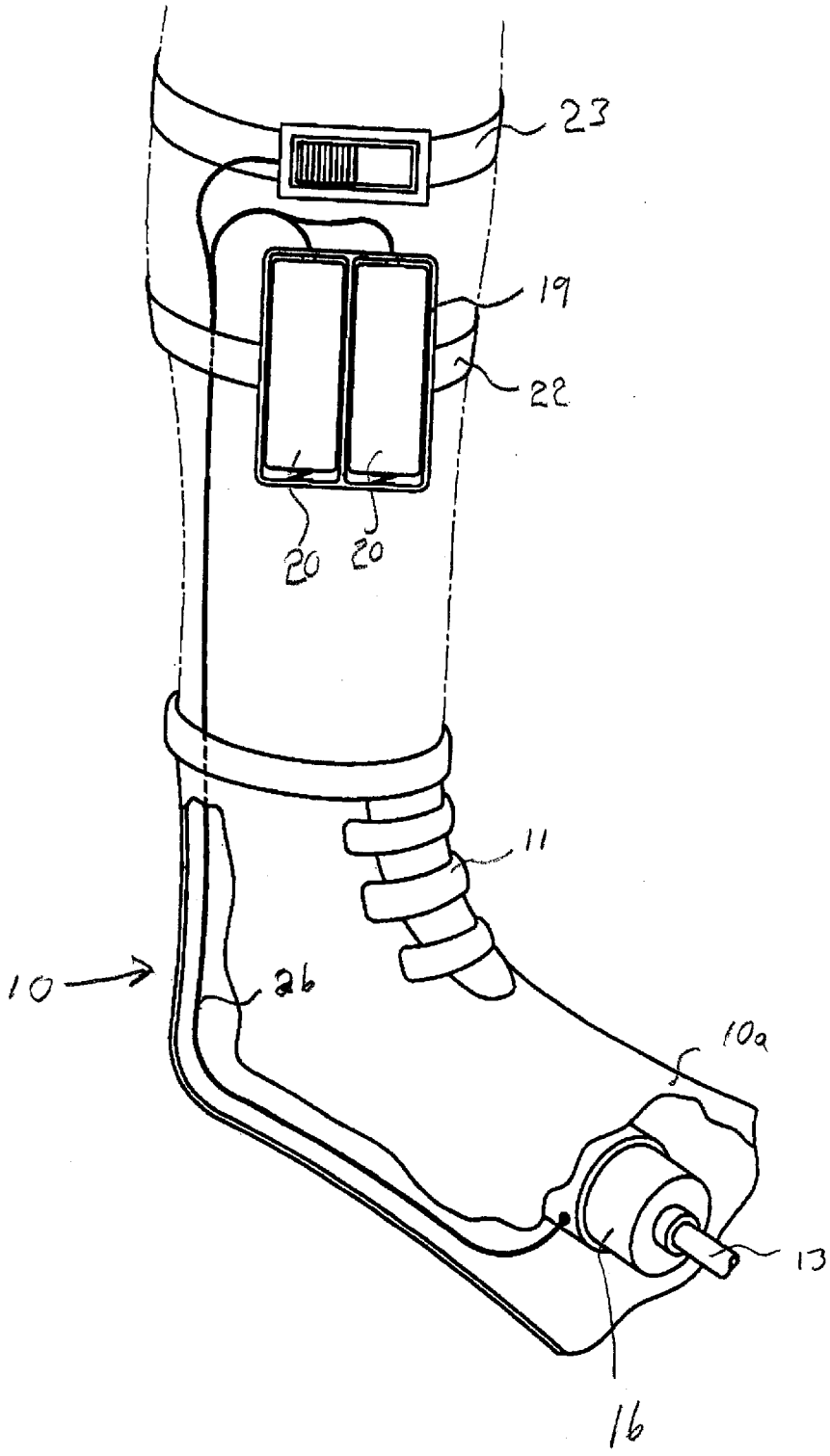
FIG 3 is a sectional plan view of the motorized swim fin of FIG. 1 taken along about line 3–3'.

Referring to FIGS. 1–3, therein is depicted a preferred embodiment of a modified swim fin device of the invention, wherein boot 10 comprises toe end 10*a* and heel end 10*b*. Securing straps 11 are located at about boot 10 so as to secure boot 10 to the foot and ankle of the wearer. Paddle 12 is illustrated as integrally formed to boot toe end 10*a* and arranged to define a generally cylindrical interior passageway "B" generally surrounding rotatable shaft 13 laying along about centerline A–A'.

Paddle 12 is illustrated as exaggerating the length and width of the toe portion of the foot to form a swimmer's fin, and comprises an inlet 14, which is located at about boot toe end 12*a* as an inlet to passageway "B", and outlet 15 which is located at about remote end of passageway "B". Mesh filter 20 is arranged about inlet 14 to screen the intake of vegetation and the like into passageway "B".

Motor 16 may be variable and/or multi-speed and is attached to about the interior of boot toe end 10*a* within paddle 12 located within passageway "B" and arranged to drive rotatable shaft 13 such that shaft 13 rotates axially along about centerline A–A'. Propeller 17 is radially center mounted onto rotatable shaft 13 such that the propeller blades are about perpendicularly situated to the shaft. Propeller 17 is located between inlet 14 and outlet 15 and secured to shaft 13 arranged to enable pushing fluid entering through inlet 14 along passageway B out through outlet 15.

Motor 16 is connected through electrical circuitry 26 to wet cell storage batteries 20 in housing 19. Variable power supply switch 21 is in electrical circuitry among the storage batteries and the motor to enable and disable the motor as desired by the wearer so as to drive rotatable shaft 13 and create a forward propulsion for the swimmer by forcing fluid through outlet 15. In functional operation, the arrangement of power supply housing 19 and switch 21 is configured to enable the greatest comfort and flexibility to the swimmer and it is contemplated that housing 19 and switch 21 may be attached to the swimmer at any convenient location by securing locking straps 22, attached at about power supply housing 19, and locking strap 23 attached at about variable switch 21.

I claim:

1. A swim fin, comprising:

a boot, having a heal end and a toe end, said boot being arranged to securely engage and surround a foot and ankle of a wearer so as to resist at least some forward and rearward flexure of said ankle;

a paddle, extending outwardly from about said toe end of said boot to a remote end, said paddle comprising a generally longitudinally extending generally tubular passageway having an inlet arranged adjacent about the toe end of said boot and an outlet arranged at about the remote end of said paddle;

wherein said tubular passageway comprises a power driven rotatable shaft having at least one propeller arranged to forcibly push fluid entering said inlet of said passageway through said outlet thereof.

2. The device of claim 1 wherein said power driven rotatable shaft is powered by an electrical motor in electrical circuitry to a switching means.

3. The device of claim 2 wherein said motor is multi-speed.

4. The device of claim 3 wherein said motor is powered by a power supply integral to said swim fin.

5. The device of claim 4 wherein said power supply comprises battery means.

6. The device of claim 4 wherein said power supply comprises fuel cell generated means.

7. The device of claim 3 wherein said motor is powered by a power supply that is remote from the said swim fin.

8. The device of claim 7 wherein said power supply comprises battery means.

9. The device of claim 7 wherein said power supply comprises fuel cell generated means.

10. The device of claim 1 wherein said rotatable shaft is enabled by the swimmer's kinetic energy.

11. The device of claim 1 wherein said boot and said paddle comprise an integrally molded unit.

12. The device of claim 1 wherein said boot and said paddle comprise separable units.

13. The device of claim 1 wherein said paddle comprises multiple inlets.

14. The device of claim 1 wherein said paddle comprises multiple outlets.

15. A swim fin, comprising:

a boot, having a heal end and a toe end, said boot being arranged to securely engage and surround a foot and ankle of a wearer so as to resist at least some forward and rearward flexure of said ankle;

a paddle, extending outwardly from about said toe end of said boot to a remote end, said paddle comprising a generally longitudinally extending generally tubular passageway having an inlet arranged adjacent about the toe end of said boot and an outlet arranged at about the remote end of said paddle;

wherein said tubular passageway comprises means for forcing fluid entering said inlet of said passageway through said outlet thereof and means for resisting the intake of vegetation into said passageway.

16. The device of claim 15 wherein said means for resisting comprises a mesh screen.

17. The device of claim 16 wherein said mesh screen is arranged at about the inlet of said passageway.

18. The device of claim 15 wherein said paddle comprises multiple inlets.

19. The device of claim 15 wherein said paddle comprises multiple outlets.

20. A modified swim fin comprising:

a boot, having a heel end and a toe end, designed to reduce at least some forward and rearward flexure of the swimmer's ankle;

a paddle, extending from said boot toe end, comprising a longitudinally extending tubular passageway, said passageway comprising an inlet and an outlet for forcibly pushing fluid therethrough;

a motor driven shaft having a propeller arranged to rotate and forcibly push fluid entering said inlet of said passageway through said outlet thereof;

and a power supply and switching means arranged remote to the swim fin in electrical circuitry with the motor driven shaft.

* * * * *